US006540341B2

(12) United States Patent
Hsieh et al.

(10) Patent No.: US 6,540,341 B2
(45) **Date of Patent: *Apr. 1, 2003**

(54) PRESSURE CONTROLLER FOR AN INK CARTRIDGE

(75) Inventors: Shu-Cheng Hsieh, Hsinchu Hsien (TW); Shyh-Haur Su, Hsinchu (TW); Cheng-Wei Hsu, Tainan Hsien (TW); Chin-Tai Chen, Kaohsiung (TW); I-Chung Hou, Hsinchu (TW); Chieh-Wen Wang, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/730,297

(22) Filed: Dec. 5, 2000

(65) Prior Publication Data

US 2001/0010531 A1 Aug. 2, 2001

(30) Foreign Application Priority Data

Jan. 29, 2000 (TW) ..... 89101544 A

(51) Int. Cl.[7] ..... B41J 2/175
(52) U.S. Cl. ..... 347/86
(58) Field of Search ..... 347/85, 86, 87, 347/92; 222/105, 206, 212

(56) References Cited

U.S. PATENT DOCUMENTS

| | | | | |
|---|---|---|---|---|
| 4,992,802 A | * | 2/1991 | Dion et al. | 347/87 |
| 5,526,030 A | | 6/1996 | Baldwin et al. | 347/87 |
| 5,608,437 A | * | 3/1997 | Iwata et al. | 347/86 |
| 6,186,620 B1 | * | 2/2001 | Hsieh et al. | 347/84 |
| 6,213,598 B1 | * | 4/2001 | Hou et al. | 347/86 |

* cited by examiner

*Primary Examiner*—Michael Nghiem
(74) *Attorney, Agent, or Firm*—Darby & Darby

(57) ABSTRACT

The ink cartridge is provided with a pressure controller to regulate the inner pressure therein by atmospheric pressure while the ink stored in the ink cartridge is gradually drained off. The ink is stored in a container with negative pressure therein, and at least one through hole formed on the container is used to connect to the atmosphere, and at least one recess is formed on the inner wall of the through hole. The pressure controller has a plug movably disposed on the through hole and the recesses. The recesses are used as a channel to allow the entrance of the atmospheric air, and the plug can be automatically moved so as to enlarge the clearance between the plug and the through hole while the ink stored in the ink cartridge is gradually drained off. The inputted air can effectively reduce the negative pressure in the container, and therefore the printing process of the ink cartridge can be proceeding steadily.

11 Claims, 8 Drawing Sheets

PRESSURE CONTROLLER FOR AN INK CARTRIDGE

BACKGROUND OF THE INVENTION

1. Field of the Invention

This invention relates to an ink cartridge. More particularly, this invention relates to an ink cartridge provided with a pressure controller so as to precisely control ink pressure therein.

2. Description of Prior Art

In the field of the printing device, "Drop-On-Demand" is a general control method used to control the flow rate of the ink dropping on the printing surface. For example, thermal bubble type printhead and piezoelectric type printhead are two classic outputting devices designed by "Drop-On-Demand".

Thermal bubble type printhead has a film resistor. The ink droplet is immediately vaporized and the expansion effect is generated as the film resistor is energized, and then parts of ink droplet is jetted out off the nozzle, and finally dropping on the printing surface. The thermal bubble type printhead controlled by the "Drop-On-Demand" will cause the ink oozing through the nozzle if it is not taken a control mechanism—to generate a predetermined negative pressure in the ink cartridge while the printing procedure is stopped.

Some of ink cartridges are provided with a "regulator", disposed in the ink container to generate negative pressure therein. In general, a regulator such as air bag is used to change the volume of the ink container by expansion or contraction so that the adequate negative pressure can be generated.

However, the volume in the ink container cannot be further increased once the maximum degree of the expansible air bag is limited. When this occurs the air bag cannot be further expanded and the ink stored in the container continues draining out, the negative pressure is relatively increased over the predetermined value. Then, the ink supply of the printhead will be abnormally terminated and then the remaining ink cannot be used.

For solving the above problem, some printing devices are applied with "bubble generator" to control the negative pressure in the cartridge. The bubble generator is provided with a designed through hole which is connected the inner space of cartridge to the ambient atmosphere and used to generate "liquid seal" with capillary forces so as to keep the ink remaining in the cartridge.

When the negative pressure is raising up to a preset value and it is larger than the capillary forces, the atmospheric air from the ambient atmosphere is quickly sucked into the ink cartridge via the through hole and scrubbed into bubbles dispersing in the ink. Then, the negative pressure can be immediately decreased by the generation of these bubbles, and then the liquid seal can be rebuild as the negative pressure is smaller than the capillary forces.

There are several crucial functions for the bubble generator. First, the negative pressure has to be precisely controlled as the bubbles are generated. Second, the variation of negative pressure in the cartridge has to be precisely controlled within a predetermined range, and the generation of the bubbles has to be terminated when the negative pressure is lower to a predetermined value. Third, "self-wetting capability" has to be provided. As the ink is about to be used up or the position of the cartridge is altered, for example, resulting in the bubble generator is not merged in the ink, the self-wetting capability of the bubble generator can effectively prevent the ambient air from entering into the cartridge.

U.S. Pat. No. 5,526,030 discloses the bubble generator provided with a through hole and a packing member. Several ribs are protruded from the inner wall of the through hole and used to position the packing member within the through hole. The packing member cannot be moved or rotated within the through hole and the gaps between the packing member and the inner wall are used to generate bubbles. The '030 case further comprises a liquid sealing device and is configured with the ability of self-wetting. For generating desirable negative in the ink pen, the annular orifice between the fixed sphere and the inside of the boss must be precisely calculated and manufactured. This increases the production cost and difficulty of fabricating the device.

SUMMARY OF THE INVENTION

To solve the above problem, the primary object of this invention is to provide an ink cartridge comprising a pressure controller so as to adjust the inner pressure therein by atmospheric pressure while the ink stored in the ink cartridge is gradually drained off. The ink cartridge has a container used to store ink with negative pressure therein. At least one through hole is formed on the container and used to connect to the atmosphere, and at least one recess is formed on the inner wall of the through hole. The pressure controller has a plug movably disposed on the through hole and the recess. The recess is designed to regulate the pressure difference between the ink in the container and the atmosphere, and the plug can be automatically shifted to enlarge the clearance between the plug and the through hole while the ink stored in the ink cartridge is gradually drained off.

BRIEF DESCRIPTION OF THE DRAWINGS

The present invention can be more fully understood by reading the subsequent detailed description and examples with reference made to accompanying drawings in which.

DETAILED DESCRIPTION OF THE PREFERRED EMBODIMENTS

Figure 1A:
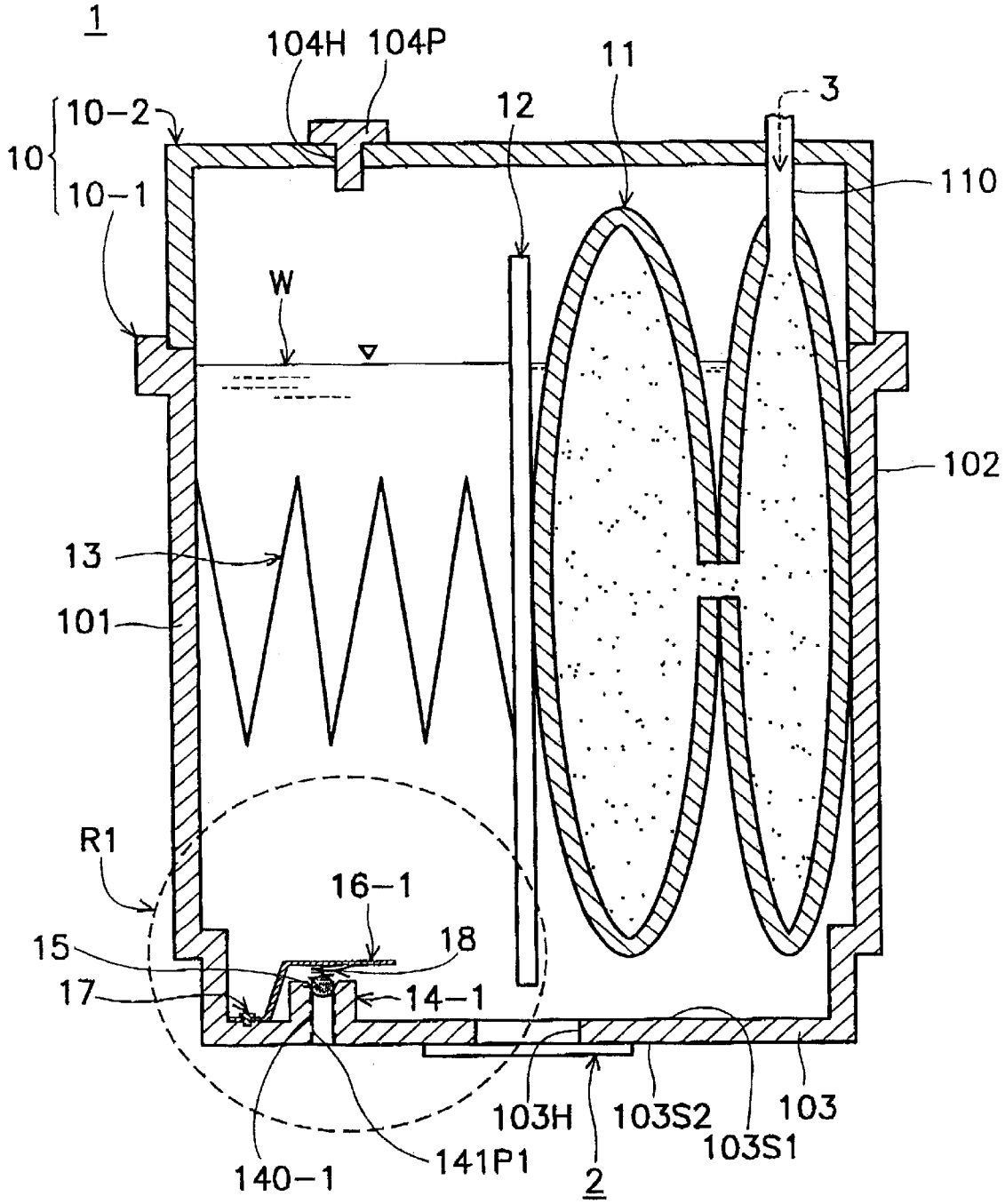
FIG. 1A is a plane view showing the inner structure of an ink cartridge (1) according to a first embodiment of the present invention.

Referring to FIG. 1A, a plane view shows the inner structure of an ink cartridge 1 according a first embodiment of the present invention.

The ink cartridge 1 comprises a container 10, an expansible chamber 11, a movable plate 12, a spring 13 and a pressure controller R1. The ink W is in the container 10 with negative pressure, and a guiding path 103H is formed on the bottom of the container 10. A printhead 2 located outside of the container 10 is connected to the guiding path 103H, wherein the ink W can be drained out by the printhead 2 through the guiding path 103H. The expansible chamber 11, the movable plate 12 and the spring 13 are partially immersed in the stored ink W, and the pressure controller R1 located at the bottom of the container 10 is fully immersed in the stored ink W.

The container 10 comprises a body 10-1 and a cover 10-2. The cover 10-2 is used to connect the body 10-1 on the top and is formed with a hole 104H which can be sealed by a cap 104P. The ink W is loaded into the container 10 through the hole 104H. The body 10-1 is composed of two side plates 101, 102 and a bottom plate 103. The expansible chamber 11 is installed in the container 10 and communicated to a gas source 3 (such as atmospheric gas) by a conduit 110. The movable plate 12 is disposed between the spring 13 and the expansible chamber 11, and the spring 13 is disposed between the side plate 101 and the movable plate 12. The movable plate 12 is attached on the expansible chamber 11, and one end of the spring 13 is connected to the side plate 101, and the another end of the spring 13 is connected to the movable plate 12. Therefore, the expansible chamber 11 can be used to move the movable plate 12, and the movement of the .movable plate 12 is limited by the spring 13.

Figure 1B:
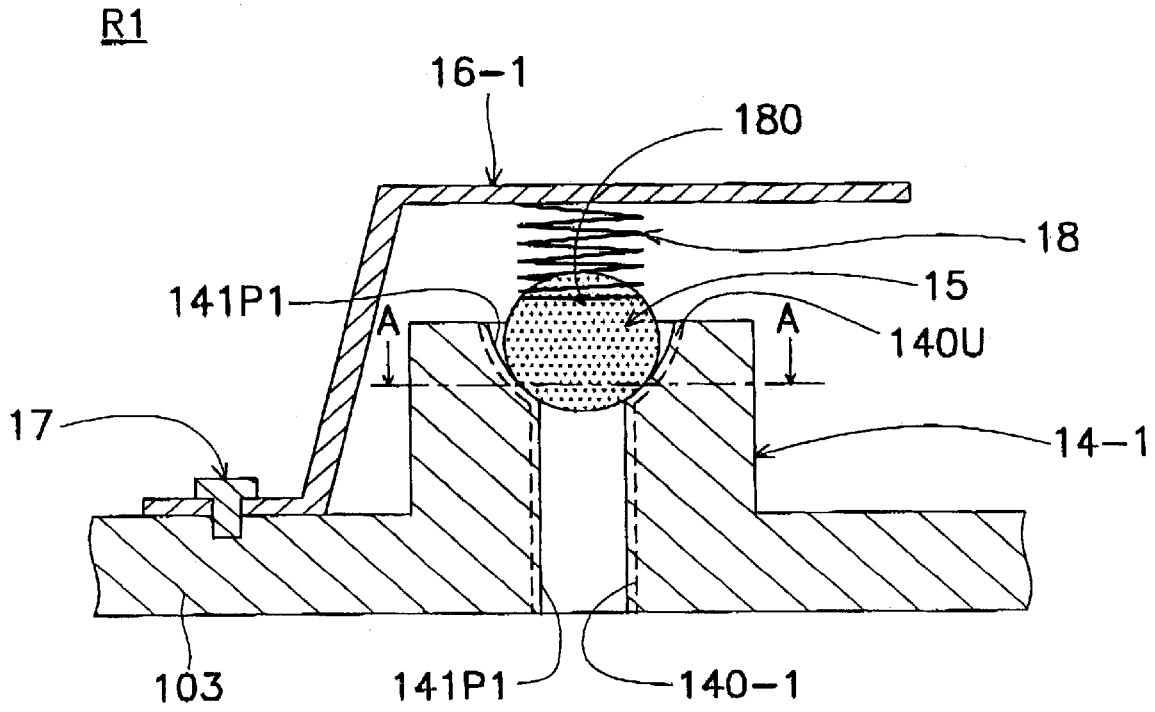
FIG. 1B is an enlarged view showing the structure of a pressure controller (R1) of FIG. 1A.

Referring also to FIG. 1B, an enlarged view shows the inner structure of the pressure controller R1 of FIG. 1A.

The pressure controller R1 can be a set or module, which can be separably installed on the container 10 or directed or formed on the container 10 as this preferred embodiment. The pressure controller R1 comprises a base 14-1, a plug 15, a plate 16-1, a connector 17 and a resilient element 18.

The base 14-1 provided with a through hole 140-1 is integrally formed on the bottom plate 103. The through hole 140-1 is used to connect the ink W in the container 10 and the atmosphere, as showed in FIG. 1A. One opening near the inner space of the container 10 of the through hole 140-1 is shaped with a semispherical space 140U.

The plate 16-1 is fixed on the bottom plate 103 by the connector 17 and used as a cantilever arm extending above the through hole 140-1 of the base 14-1. The resilient element 18 is a spring used to connect to the plate 16-1 and provided with a contacting end 180 faced toward the semispherical space 140U. The plug 15 is a ball disposed between the contacting end 180 of the resilient element 18 and the base 14-1, wherein the plug 15 is pushed by the resilient element 18 and uniformly pressed on the protrusions 141P.

Figure 1C:
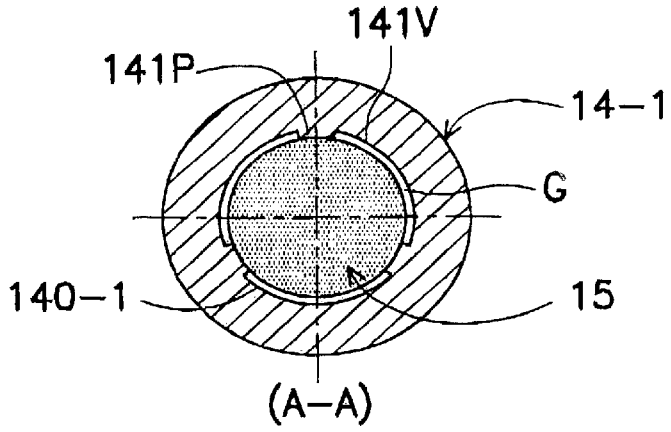
FIG. 1C is a cross-sectioned view according to the line A—A of FIG. 1B.

Referring to FIG. 1C, the cross-sectional view by the line A—A of FIG. 1B shows the geometrical relationships between the plug 15 and the base 14-1. Three recesses 141V are formed on the inner wall of the through hole 140-1 and separated by the protrusions 141P. Thus, three clearances G (recesses 141V) are formed among the base 14-1, the plug 15 and the protrusions 141P at the present situation.

When the printing process is underway and the ink W in the container 10 is gradually drained off, the negative pressure in the container 10 is gradually increased and the back pressure located at the plug 15 is relatively elevated. Once the negative pressure in the container 10 is increased over a critical value, the atmospheric air can be immediately sucked into the container 10 via the through hole 140-1 and the clearances G and it is dispersed into the ink W in the form of bubbles. Then, the negative pressure in the container 10 can be immediately increased.

Once the negative pressure in the container 10 is greatly larger than the pressure of the atmospheric air and it cannot be effectively increased by the aforementioned method, the negative pressure pushes the plug 15 pressing on the resilient member 18 toward the plate 16-1. Then, the clearance between the plug 15 and the through hole 140-1 is enlarged and it allows more air entering the container 10 to reduce the negative pressure in the container 10.

In addition, owing to the expansible chamber 11 is connected to the atmospheric gas source 3, the pressure in the expansible chamber 11 is decreased when the ink cartridge 1 is moved from a lower altitude to a higher altitude such as transported by flight. Thus, the pressure in the expansible chamber 11 is decreased by the atmospheric gas source 3 and the expansible chamber 11 is relatively contracted. With the decreasing of the inner pressure of the container 10, the air can be immediately sucked into the container 10 by passing the clearance G, and then the negative pressure in the container 10 can be immediately reduced and there is no ink oozed from the printhead 2. With the regulation of the clearances G between the inside and outside of the container 2, therefore, the printing process can be proceeded with stable, and the negative pressure can be precisely controlled within a designed range by regulating the inflow rate of air outside.

Figure 2A:
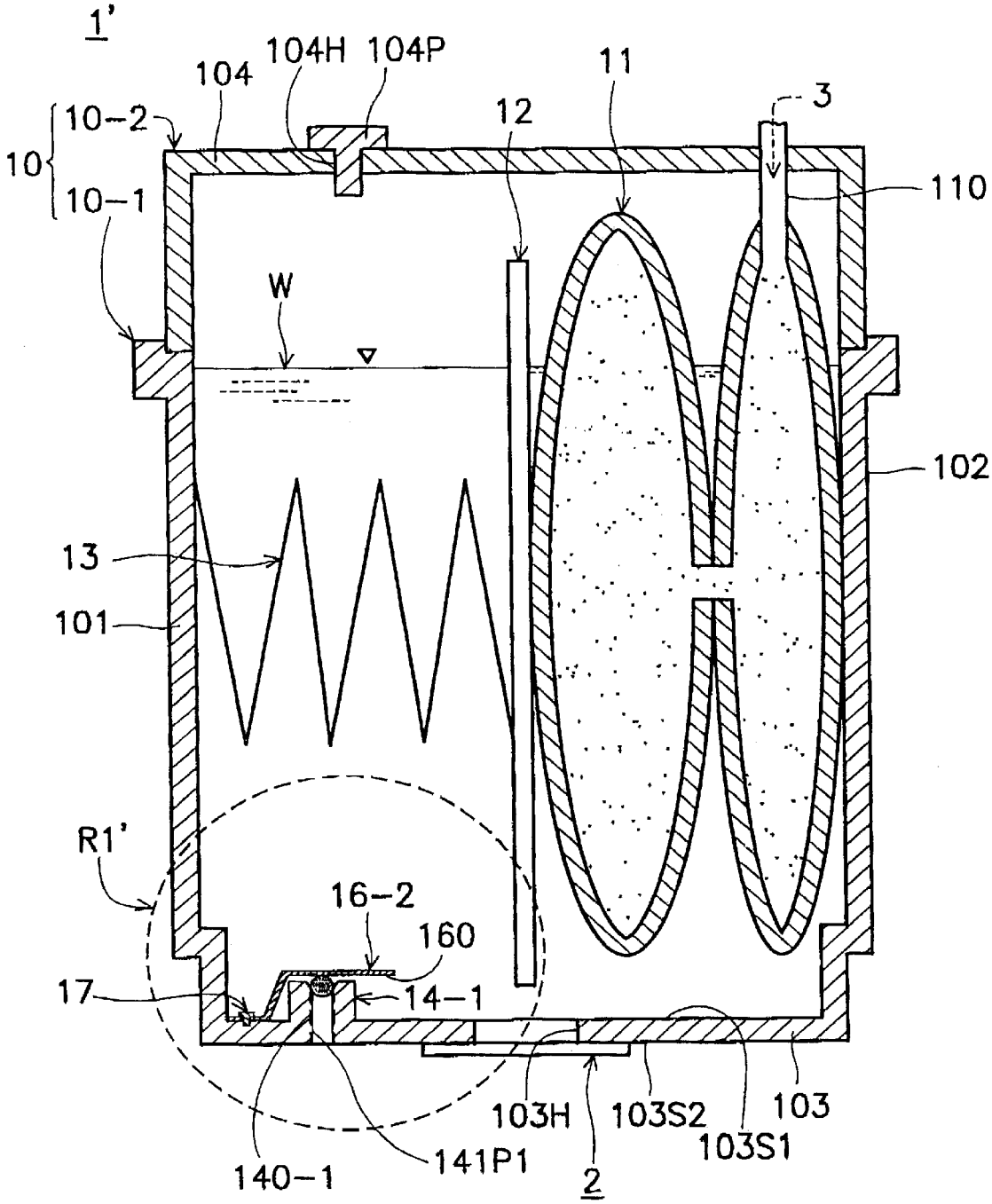
FIG. 2A is a plane view showing the inner structure of the ink cartridge (1') according to a second embodiment of the present invention.
Figure 2B:
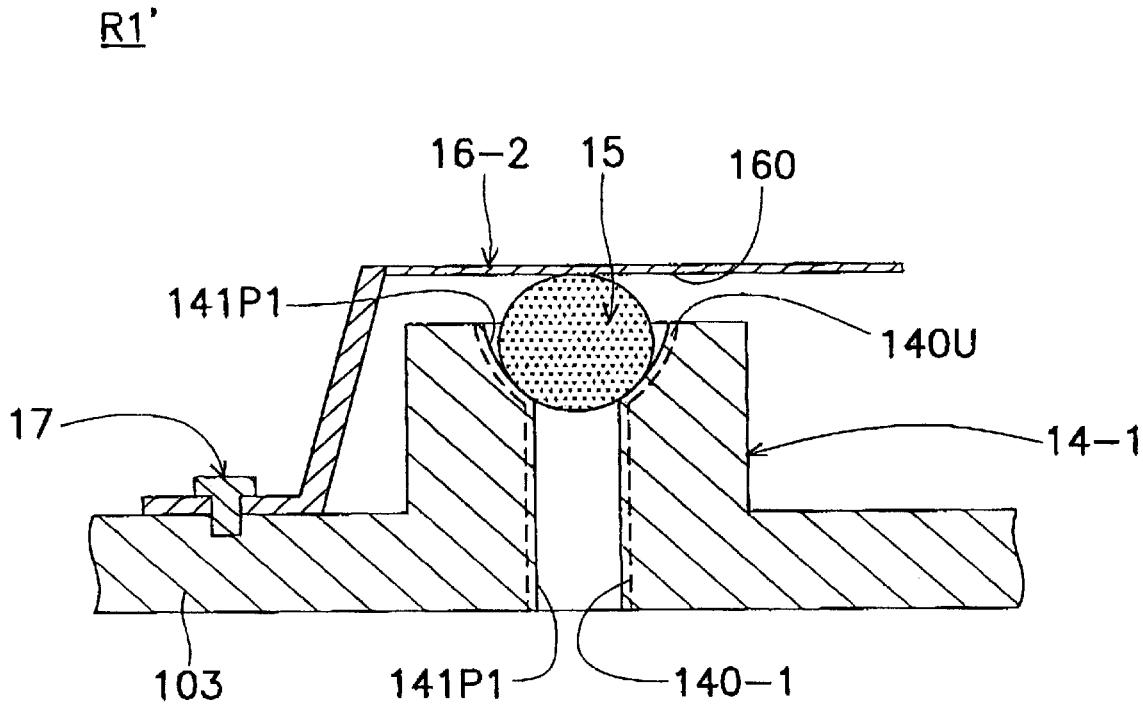
FIG. 2B is an enlarged view showing the structure of a pressure controller (R1') of FIG. 2A.

Referring to FIG. 2A and FIG. 2B, FIG. 2A shows the inner structure of the ink cartridge 1' according to a second embodiment of the present invention, and FIG. 2B shows the structure of a pressure controller R1' of FIG. 2A.

The second embodiment differs from the first embodiment in that the spring 18 in FIG. 1A is removed, and a reed 16-2 replaces the plate 16-1. The same elements in FIG. 2A and FIG. 2B are denoted the same symbols as the first embodiment. The reed 16-2, a resilient element, has a contacting end 160 used for pressing the plug 15 on the protrusions 141P1 of the base 14-1 and limiting the plug 15 at the semispherical space 140U.

Figure 3A:
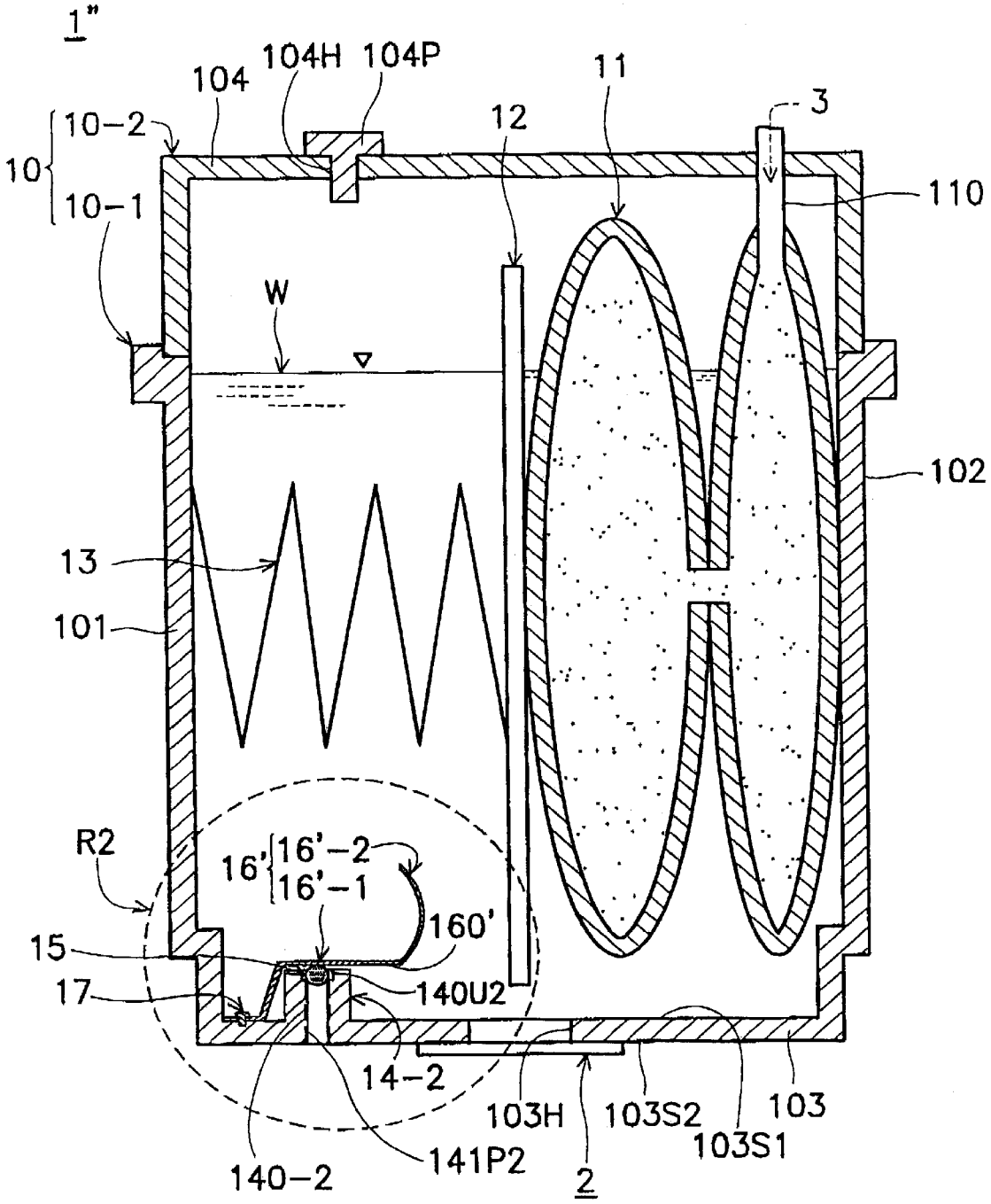
FIG. 3A is a plane view showing the inner structure of the ink cartridge (1") according to a third embodiment of the present invention.

Referring to FIG. 3A, a plan view shows the inner structure of the ink cartridge 1" according to a third embodiment of the present invention. The third embodiment differs from the first and the second embodiments in that the movable plate 12 is used to replace the spring 18 (FIG. 1A) or reed 16-2 (FIG. 2A) to control the movement of the plug 15.

Figure 3B:
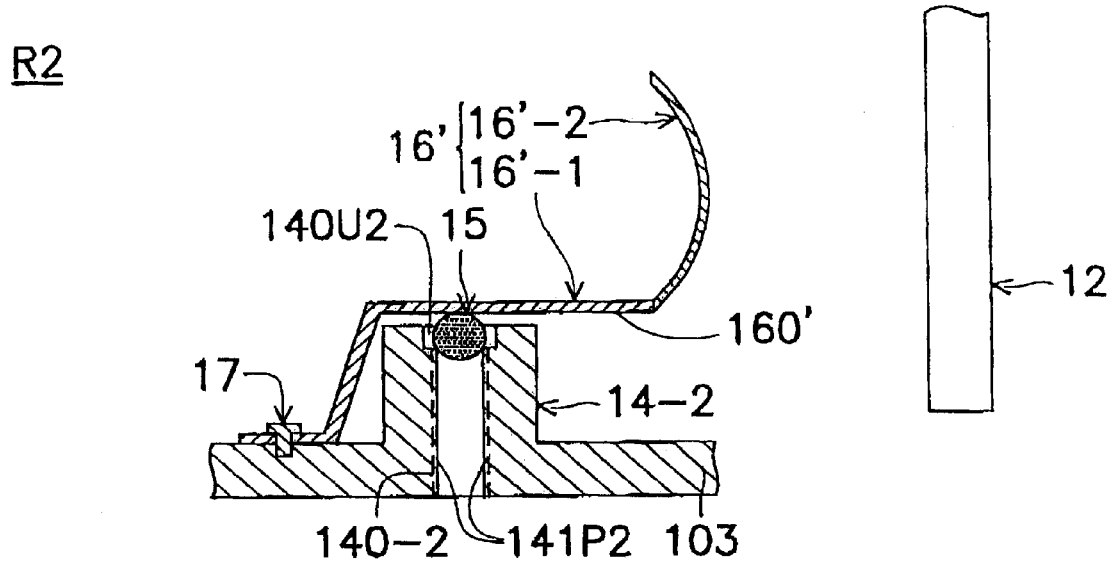
FIG. 3B is an enlarged view showing the structure of a pressure controller (R2) of FIG. 3A.
Figure 3C:
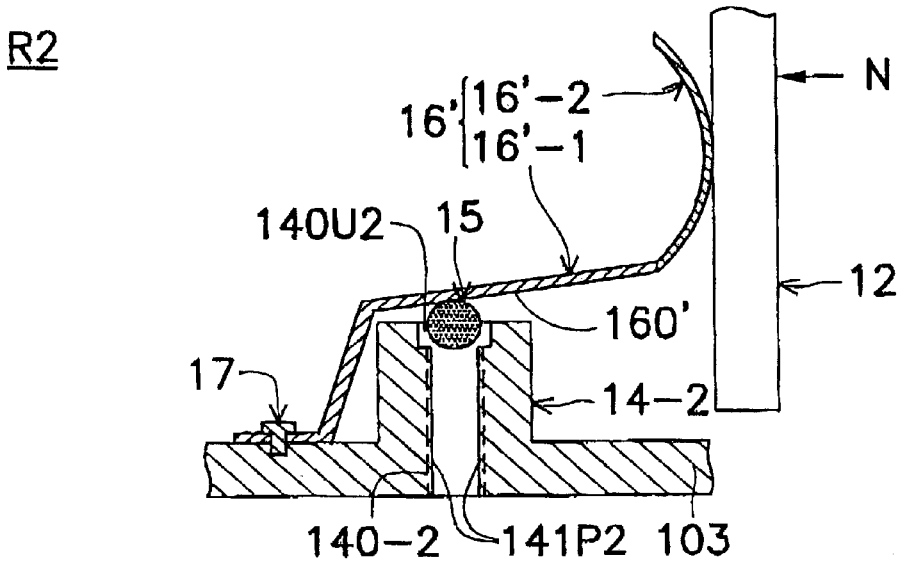
FIG. 3C is a plan view showing the pressure controller (R2) being actuated of FIG. 3B.

Referring to FIG. 3B and FIG. 3C, FIG. 3B shows the detailed structure of a pressure controller R2 of FIG. 3A, and FIG. 3C shows the pressure controller R2 being actuated by the movable plate 12.

As shown in FIG. 3B, the pressure controller R2 has a base 14-2 formed with a through hole 140-2, and the through hole 140-2 is provided with a space 140U-2 and a plurality of protrusions 141 P2 therein. A plate 16' is used as a cantilever disposed above the through hole 140-2 and it is composed of two portions 16'-1 and 16'-2. The portion 16'-1 has a contacting end 160' faced toward the through hole 140-2 and is fixed on the bottom plate 103 by the connector 17, so that the plug 15 can be uniformly pressed on the protrusions 142P2 by the portion 16'-1.

In FIG. 3C, as the expansible chamber 11 is inflated with gas supplied from the gas source 3, the movable plate 12 is moved toward the plate 16' and then contacts the portion 16'-2 of the plate 16'. Then, the inflating expansible chamber 11 causes the moving plate 12 pressing on the plate 16' and results in the plate 16' substantially rotated above the fixed connector 17. The portion 16'-1 is shifted with a slant angle away from the base 14-2 and the space between the plate 16' and the base 14-2 is enlarged. Then, the plug 15 is not fixedly pressed by the plate 16' and it can locally move between the plate 16' and the base 14-2, and the clearance between the plug 15 and the through hole 140-2 can be enlarged. Although the plug 15 can freely move within the space 140U2, the plug 15 is still constrained between the plate 16' and the base 14-2. Therefore, the atmospheric air can be immediately sucked into the container 10 via the enlarged clearances G and it is dispersed into the ink W in the form of bubbles.

Once the plug 15 is stuck as the plate 16' is pressed, the atmospheric air still can be sucked into the container 10 via the minimum clearances among the plug 15 and the protrusions 141P2 and dispersed itself into the ink W in the form of bubbles.

Figure 4:
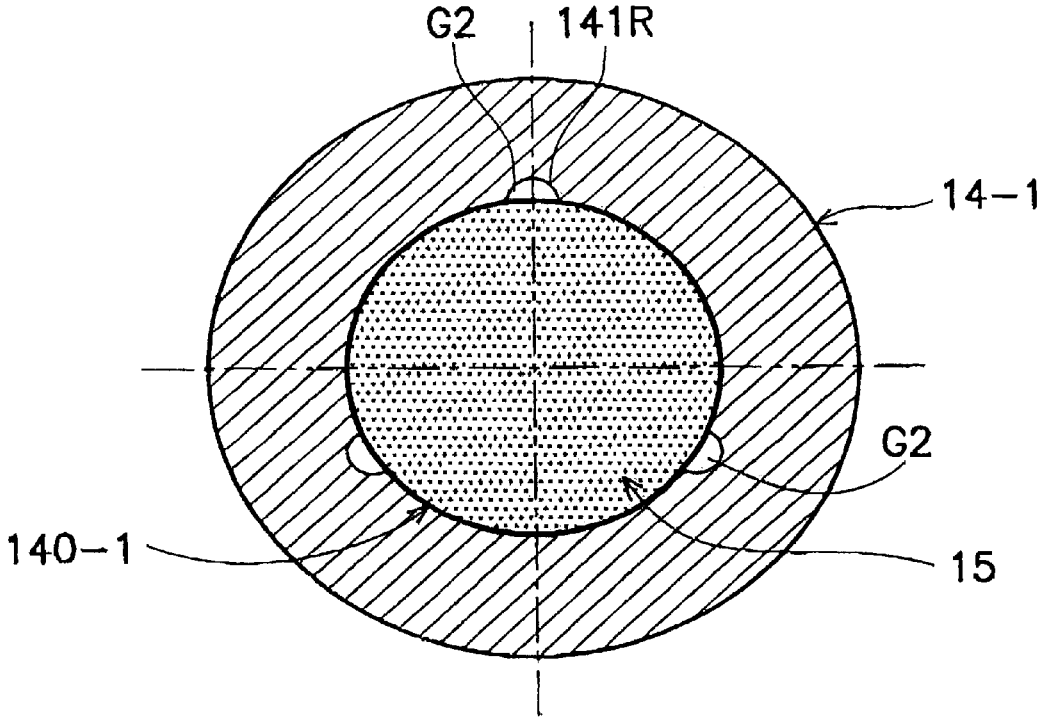
FIG. 4 is a plan view showing another derivative example according to FIG. 1C.

Referring to FIG. 4, a plan view shows another derivative example according to FIG. 1C. In FIG. 4, three grooves 141R, instead of the protrusions 141P, are formed on the inner wall of the through hole 140-1, and therefore three clearances G2 are formed between the base 14-1 and the plug 15 as the plug 15 is pressed on the base 14-1.

Figure 5A:
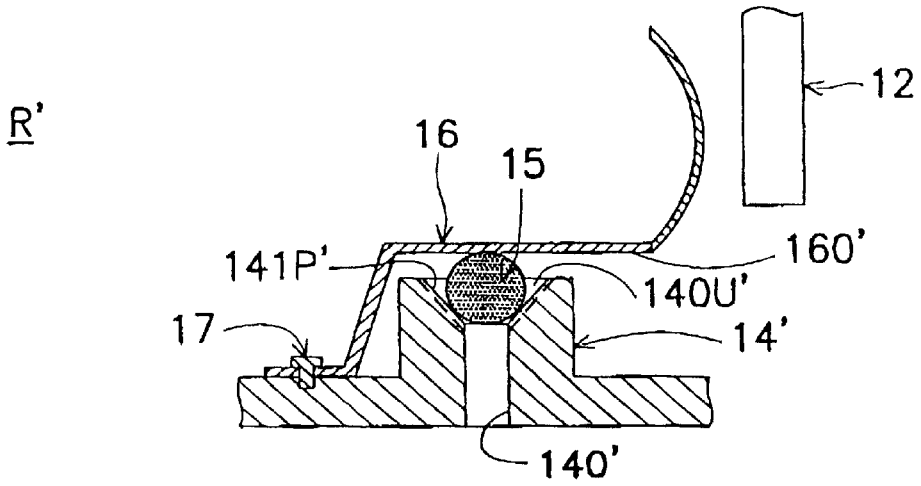
FIG. 5A is a plan view showing the structure of a pressure controller (R') according to a fourth embodiment of the present invention.
Figure 5B:
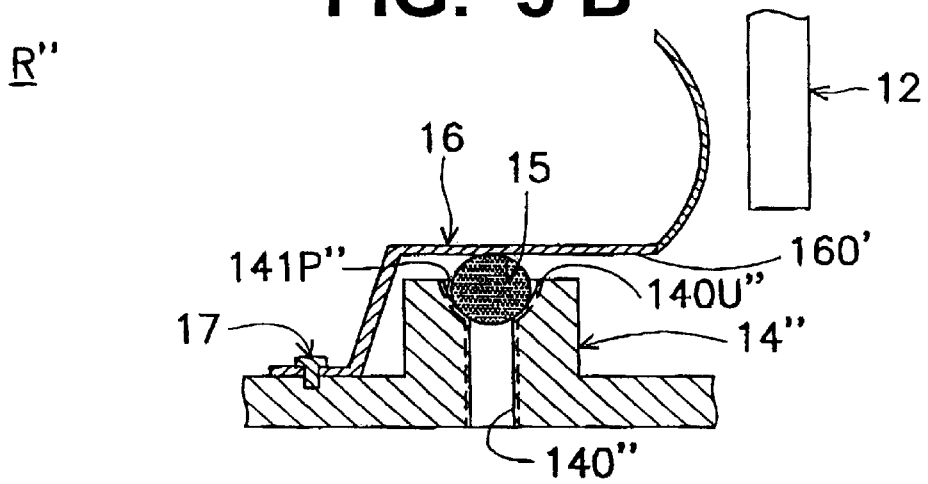
FIG. 5B is a plan view showing the structure of a pressure controller (R") according to a fifth embodiment of the present invention.
Figure 5C:
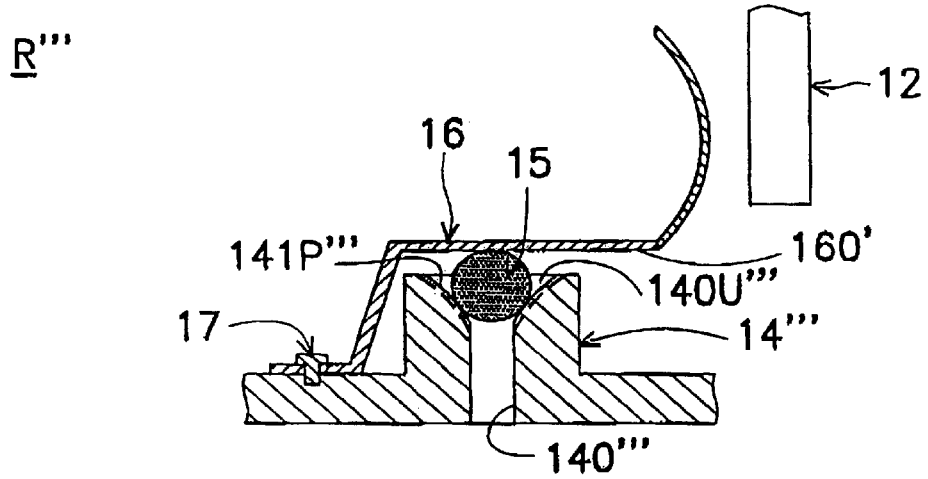
FIG. 5C is a plan view showing the structure of a pressure controller (R'") according to a sixth embodiment of the present invention.

Referring to FIGS. 5A~5C, three plan views respectively show the structure of three different types of pressure controller R', R", R'" according to a fourth, fifth and sixth embodiment of the present invention. Three spaces 140U', 140U", 140U'" with different shapes are respectively provided in a through hole 140' of a base 14', a through hole 140" of a base 14" and a through hole 140'" of a base 14'". Protrusions 141P', 141P", 141P'" are respectively formed on the spaces 140U', 140U", 140U'".

In FIG. 5A, the plug 15 is pressed on the protrusion 141P'and located in the space 140U' by the plate 16. In a FIG. 5B, the plug 15 is pressed on the protrusion 141P" and located in the space 140U" by the plate 16. In FIG. 5C, the plug 15 is pressed on the protrusions 141P'" and located in the space 140U'" by the plate 16. Once the negative pressure in the container 10 is increased, the clearances between the plug 15 and the through hole 140' (140" or 14'") allow the atmospheric air to enter the container 10.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. An apparatus for controlling an ink cartridge having ink stored under negative pressure therein, comprising:

a base installed on said ink cartridge, having a through hole used for connecting the ink stored in said ink cartridge to an atmosphere and provided with an inner wall formed with at least one recess thereon;

a resilient element disposed next to said base and provided with a contacting end; and a plug movably disposed between said contacting end of said resilient element and said through hole, used for regulating pressure difference between the ink stored in said ink cartridge and the atmosphere.

2. The apparatus as claimed in claim 1, wherein said base is integrally formed on said ink cartridge.

3. The apparatus as claimed in claim 2, wherein said resilient element is a spring.

4. The apparatus as claimed in claim 2, wherein said resilient element is a reed.

5. The apparatus as claimed in claim 1, wherein said ink cartridge further comprises a chamber to control said resilient element.

6. The apparatus as claimed in claim 1, wherein a cantilever plate is further provided and disposed in said container, and said resilient element is extended from said cantilever plate.

7. An ink cartridge, comprising:

a container used for storing ink with negative pressure therein, having at least one through hole connected to the atmosphere and provided with an inner wall formed with at least one recess thereon;

a resilient element disposed next to said through hole and provided with a contacting end; and a pressure controller used for regulating pressure between the ink stored in said container and the atmosphere, having a plug movably disposed between said contacting end of said resilient element and said through hole.

8. The ink cartridge as claimed in claim 7, wherein said resilient element is a spring.

9. The ink cartridge as claimed in claim 8, wherein said resilient element is a reed.

10. The ink cartridge as claimed in claim 9, further comprising a chamber to control said resilient element.

11. The apparatus as claimed in claim 6, wherein a cantilever plate is further provided and disposed in said container, and said resilient element is extended from said cantilever plate.

* * * * *